United States Patent [19]

Shore

[11] Patent Number: 4,856,689

[45] Date of Patent: Aug. 15, 1989

[54] ARTICLE CARRIER

[76] Inventor: Dennis Shore, 4219 Fort Donelson Dr., Stockton, Calif. 95209

[21] Appl. No.: 771,576

[22] Filed: Aug. 30, 1985

[51] Int. Cl.[4] ..... A45C 7/00

[52] U.S. Cl. ..... 224/218; 224/917; 224/264; 294/147

[58] Field of Search ..... 294/147; 224/218, 220, 224/917, 264

[56] References Cited

U.S. PATENT DOCUMENTS

| | | | |
|---|---|---|---|
| 452,830 | 5/1891 | Bowie et al. | 224/220 |
| 3,768,711 | 10/1973 | Wilkinson | 294/147 X |
| 4,002,277 | 1/1977 | Westerholm | 294/147 |
| 4,488,748 | 12/1984 | Burkes | 294/147 |
| 4,553,779 | 11/1985 | Shortridge | 294/147 |

FOREIGN PATENT DOCUMENTS

| | | | |
|---|---|---|---|
| 2501996 | 9/1975 | Fed. Rep. of Germany | 294/147 |
| 3128920 | 2/1983 | Fed. Rep. of Germany | 224/257 |

*Primary Examiner*—Henry J. Recla
*Attorney, Agent, or Firm*—Leonard Bloom

[57] ABSTRACT

A device for transporting articles including a cover which supports first and second strands of flexible material such that each strand defines a plane and both strands are oriented in mutually transverse planes, whereby when deployed the strands depend from the protective cover and engage articles to be carried. When stored the strands are carried within the cover.

17 Claims, 1 Drawing Sheet

ARTICLE CARRIER

FIELD OF THE INVENTION

The present invention relates generally to article carriers, and more specifically to a carrier for accommodating ski boots, poles and skis.

BACKGROUND OF THE INVENTION

Snow skiing entails the use of equipment, most of which can only be used on the slope itself. While boots, skis, and poles are worn by the skiers during skiing, they must first be transported from a parking area to the area of actual skiing. Skis and poles themselves are cumbersome to carry since they tend to get skewed. The problem is exacerbated when one is carrying skis for more than one person, typical in a family outing where children are involved who have yet to develop the requisite skill for carrying the equipment. Boots, of course, are uncomfortable to walk in since they don't flex where required when walking.

It would be desirable therefore, to provide an instrumentality which would allow a plurality of articles such as ski equipment to be compactly constrained in a single bundle adapted to be held in depending relationship from a portion of a person's body.

SUMMARY OF THE INVENTION

Accordingly, it is the primary object of the present invention to provide an improved apparatus for bundling ski equipment so as to facilitate its transport from one area to another.

A further object of this invention contemplates providing a device as characterized above which is relatively light in weight thereby not appreciably adding to the pre-existing burden.

Yet a further object of this invention is to provide a device as characterized above which is extremely compact so as to lend itself to facile storage when not in use.

It is yet another object of this invention to provide a device as characterized above which is relatively inexpensive to manufacture and lends itself to mass production techniques.

A particular object allows strands which suppport the ski equipment to be stored within a cover like membrane when not in use.

A further object contemplates providing a device as characterized above which is durable in construction and reliable in service.

A further object is evidenced when the ski, boot and pole carrier is embodied as:

- a first strand of flexible cord having free ends provided with fastening means, said free ends circumscribing a pair of skis and poles with each said fastening means further reattached to said first strand just upstream from the area of circumscription which girds the skis and poles,
- a second strand of flexible cord embodied as a closed loop adapted to engage buckles on ski boots, thereby supporting the boots,
- and means for jointly supporting said first and second strands whereby the skis, boots and poles can concurrently be held in depending relation from said supporting means.

A further object is to provide a device wherein said supporting means is formed from a blank of flexible membrane having means for retaining said membrane in a rolled up configuration, two pairs of grommet or eyelet means radially spaced from a geometric center of said blank whereby each adjacent eyelet is spaced from its neighbor by 90 degrees, and said first strand passes through one pair of said eyelets, said second strand passes through said second pair of eyelets.

A further object is to provide a device wherein said first pair of eyelets are removed further from the geometrical center of said blank than said second pair.

A further object is to provide a device wherein said attaching means are disposed in line with said second pair of eyelets.

A further object is to provide a device wherein said first strand underlies said second strand on an outer surface of said membrane.

A further object is to provide a device wherein said fastening means for said first strand include a clasp attached to each free end of said strand having a biasing latch selectively allowing access to an interior of said clasp.

A further object is to provide a device wherein a plurality of disparate articles hang in depending relation therefrom and includes:

a flexible membrane formed as a rectangular blank having complimental retaining means medially disposed and inboard of two diametrically opposed side edges to allow said membrane to be oriented from a first planar configuration to a second rolled and tubular configuration, a first pair of grommets placed inboard of and on the remaining two side edges of said blank through which passes a first strand of flexible cord for tethering articles thereto, and a second pair of grommets axially aligned with and inboard said retaining means through which passes a second strand of flexible cord for tethering further articles thereto.

A further object is to provide a device wherein said first strand of flexible cord includes free ends provided with fastening means said free ends circumscribing a pair of skis and poles with each said fastening means further reattached to said first strand just upstream from an area of circumscription which girds the skis and poles, said second strand of flexible cord embodied as a closed loop adapted to engage buckles on ski boots, thereby supporting the boots.

A further object is to provide a device wherein said fastener means are embodied as clasps having a spring biased latch which allows access to the interior of said clasp.

A further object is to provide a device wherein said fastener is supported on a free ended strand by swivel means.

A further object is to provide a device wherein said complimental retainer means are embodied as a male and female snap fasteners.

A further object is to provide a device wherein said first flexible strand has a portion thereof which rides along an outer face of said flexible membrane and between said first pair of eyelets with said second strand overlying said first strand at that portion to assist in force distribution.

A method for carrying articles is a further object which includes the steps of providing a blank of material with two pairs of eyelets spaced in a cruciformed fashion, providing first and second strands of flexible material in respective pairs of eyelets whereby said first strand has free ends and said second strand defines a closed loop, providing fastening means at distal extremities of said free ends, looping said free ends around articles to be carried and using said fastening means to reconnect to said flexible strands just upstream from the area which circumscribes the article to be carried, and attaching further articles to be carried on said closed loop strand.

These and other objects will be made manifest when considering the following detailed specification when taken in conjunction with the appended drawing figures.

DESCRIPTION OF THE DRAWING FIGURES

DESCRIPTION OF THE PREFERRED EMBODIMENT

Figure 1:
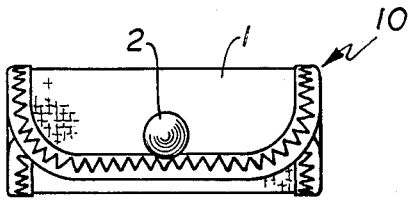
FIG. 1 is a top plan view of the apparatus according to the present invention in its stored configuration.

Referring to the drawings now, wherein like reference numerals refer to like parts throughout the various drawings figures, reference numeral 10 is directed to the kit for carrying a plurality of disparate articles according to the present invention.

Figure 2:
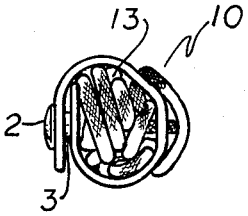
FIG. 2 is an end view thereof.
Figure 4:
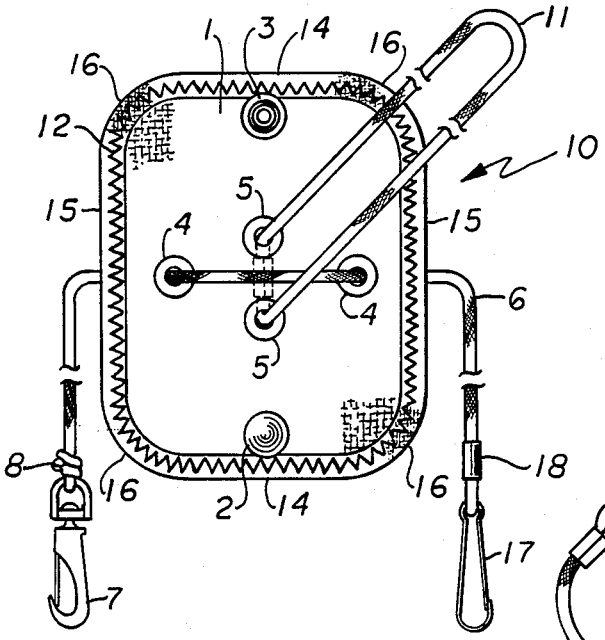
FIG. 4 is a plan view showing the apparatus of Figure 1 in an open and unfolded position preparatory to deployment with articles to be carried.

As shown in FIGS. 2 and 4, the kit is formed from a flexible membrane having an outer surface 1, an inner surface 13 formed as a rectangular blank including spaced parallel pairs of edges 14 and 15, with edges 15 optionally being of slightly greater length than edges 14. The intersecton of adjacent edges have corners 16 which may be radiused. In one form of the invention, the finished product may have a finished stitched border 12 circumscribing the periphery of the blank as shown.

Figure 3:
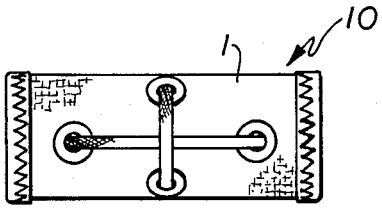
FIG. 3 is a bottom view of that which is shown in FIG. 1.

The flexible membrane is selected from a class of materials including but not limited to various plastics and elastomerics, leathers, cloth, canvas, or elastomeric impregnated cloth or canvas characterized in that while having a certain degree of stiffness, the membrane it is still capable of deformation as suggested in FIGS. 1 through 3.

Slightly inboard of edges 14 and medially disposed, a snap fastener having a male portion 2 and a female portion 3 are provided diametrically opposed so that when the membrane is rolled to a substantially cylindrical configuration, the snaps are in alignment for mating registry.

Further inboard from the side edges 14 and aligned by the axis defined between the snap fasteners, first and second grommet type eyelets 5 are provided through a strand 11 which is disposed. The strand 11 is embodied as a closed loop formed from flexible cord with its free ends united either by a knot 8 or held in place by means of crimped tubing 18. Each of the eyelets 5 are offset slightly an equal distance from the geometrical center of the blank 1.

Figure 5:
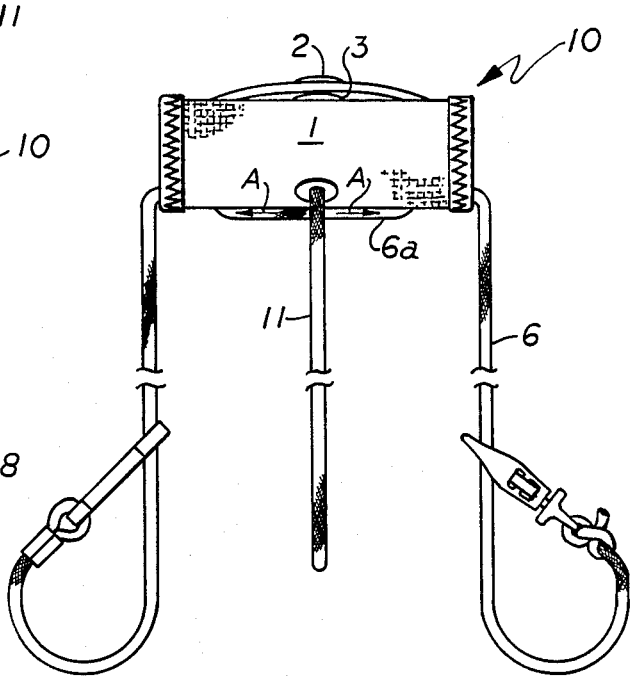
FIG. 5 is a side view of the apparatus of FIG. 4 as when deployed but the articles to be carried have been deleted for clarity.

Slightly inboard from the two remaining opposed edges 15, a second pair of grommet type eyelets 4 are provided through which pass a further strand of flexible cords 6 such that a section of the cords 6 extends between and underlies cord 11 as shown in FIG. 4. Each end of the strand 6 is provided with a fastener 17 or 7 which allows the free ends of the strand 6 to be looped back over the carried article and fastened to the strand just upstream forming a loop. In one form of the invention, the fastener 7 is embodied as a swivel clasp spring biased latch having a receiving area into which the flexible cord is placed by moving a biasing strip which affords access to the receiving area. In a second form of the invention, a fastener 17 is used which omits the swivel. As shown in FIG. 5, the fastener 7 or 17 engages the strand so that a loop is formed which can circumscribe the article to be carried. For example, in FIG. 6 the strand 6 and its associated free ends circumscribe a pair of skis and poles outboard of the center of gravity of the skis so that the looped portion which circumscribes the skis and poles and the flexible cord 6 running to the membrane 1 can carry them.

Figure 6:
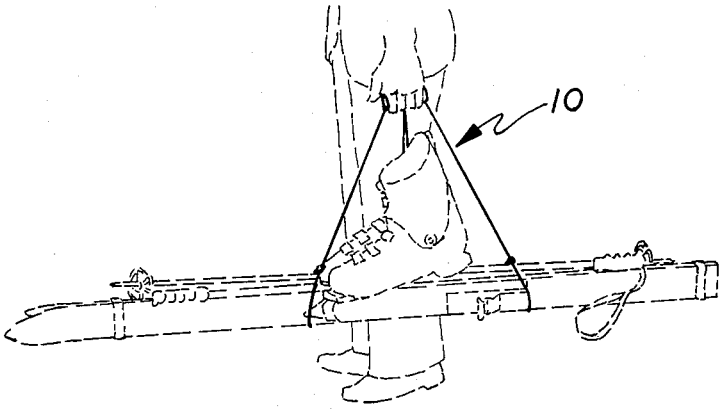
FIG. 6 is a side view of the apparatus deployed.
Figure 7:
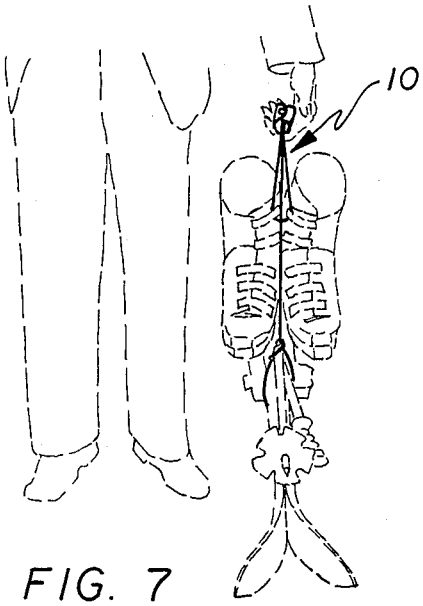
FIG. 7 is a front view of that which is shown in FIG. 6.

As shown also in FIGS. 6 and 7, the closed loop strand is used to support ski boots by threading the buckles common to most ski boots around the loop and rebuckling that specific buckle so that it is tethered to the strand. As shown in the illustrative embodiments of FIGS. 6 and 7, the boots hang from the flexible membrane 1 above the skis. Clearly, however, should loop 11 be made longer or strands 6 shorter, the boots can ride below the skis.

It is important to note that the flexible strand 11 which supports the boots emanates from a medial portion of the blank 1 when rolled into tubular configuration as shown in Figure 5 for example. The strand 6 having free ends emanate from the open ends of the rolled up tube so that when the article carrier is grasped, the closed loop strand 11 depends from between the fingers of the person carrying the device. By having the strand 6 include a portion **6*a* which appears on the outer periphery of the rolled up blank 1 as shown in FIG. 5, a line of force is provided which extends along the length of the lower most portion of an outer wall of a flexible membrane and serves to offset the downward force caused by the strand 11 so as to resist deformation of the flexible membrane 1 when used in transporting the skis. That is to say, the strand 6 is in a state of tension as indicated by the arrows A of FIG. 5 and this tension finds the force vectors moving in opposite directions substantially where the closed loop 11 exists so that the weight of the boots and the closed loop strand 11 are offset and negated somewhat by the strand 6 having opposing force vectors at the intersection of the strand 11 and the strand 6**. This effectively distributes the boots weight along the width of the hand.

Moreover, having thus described the invention, it should be apparent that numerous structural modifications are contemplated as being a part of this invention as set forth hereinabove and as defined hereinbelow by the claims.

I claim:

1. A ski, boot and pole carrier comprising in combination:

a first strand of flexible cord having free ends provided with fastening means, said free ends circumscribing a pair of skis and poles with each said fastening means further reattached to said first strand just upstream from an area of circumscription which girds the skis and poles, a second strand of flexible cord embodied as a closed loop adapted to engage buckles on ski boots, thereby supporting the boots, and flexible membrane means for jointly supporting said first and second strands whereby the skis, boots and poles can concurrently be placed in depending relation from said supporting means whereby in use said flexible membrane support means can conform to the portion of one's body which actually does the carrying and when in storage, said flexible membrane means provides a soft object which protects a falling skier.

2. The device of claim 1 wherein said supporting means is formed from a blank of said flexible membrane having means for retaining said membrane in a rolled up configuration, two pairs of eyelet means radially spaced from a geometric center of said blank whereby each adjacent eyelet is spaced from its neighbor by 90 degrees, and said first strand passes through one pair of said eyelets, said second strand passes through said second pair of eyelets.

3. The device of claim 2 wherein said first pair of eyelets are removed further from the geometrical center of said blank than said second pair.

4. The device of claim 3 wherein said retaining means are disposed in line with said second pair of eyelets.

5. The device of claim 4 wherein said first strand underlies said second strand on an outer surface of said membrane.

6. The device of claim 5 wherein said fastening means for said first strand includes a clasp attached to each free end of said strand having a biasing latch selectively allowing access to an interior of said clasp.

7. A kit for carrying a plurality of disparate articles in depending relation therefrom comprising, in combination:

a flexible membrane formed as a rectangular blank having complimental retaining means medially disposed and inboard of two diametrically opposed side edges to allow said membrane to be oriented from a first planar configuration to a second rolled and tubular configuration, a first pair of eyelets placed inboard of and on the remaining two side edges of said blank through which passes a first strand of flexible cord for tethering articles thereto, and a second pair of eyelets axially aligned with and inboard said retaining means through which passes a second strand of flexible cord for tethering further articles thereto whereby in use said flexible membrane can conform to the portion of one's body which actually does the carrying and when in storage, said flexible membrane means provides a soft object which protect a falling skier.

8. The kit of claim 7 wherein said first strand of flexible cord includes free ends provided with fastening means said free ends circumscribing a pair of skis and poles with each said fastening means further reattached to said first strand just upstream from an area of circumscription which girds the skis and poles, said second strand of flexible cord embodied as a closed loop adapted to engage buckles on ski boots, thereby supporting the boots.

9. The device of claim 8 wherein said fastener means are embodied as clasps having a spring biased latch which allows access to the interior of said clasp.

10. The device of claim 9 wherein said fastener is supported on a free end of said first strand by swivel means.

11. The device of claim 10 wherein said complimental retainer means are embodied as a male and female snap fastener.

12. The device of claim 11 wherein said first flexible strand has a portion thereof which rides along an outer face of said flexible membrane and between said first pair of eyelets with said second strand overlying said first strand of that portion to assist in force distribution.

13. A method for carrying articles including the steps of providing a blank of material with two pairs of eyelets oriented in a cruciform fashion, providing first and second strands of flexible material through respective pairs of said eyelets whereby said first strand has free ends and said second strand defines a closed loop, and providing fastening means at distal extremities of said free ends whereby in use said blank can conform to the portion of one's body which actually does the carrying and when in storage, said blank provides a soft object with protects a falling skier.

14. The method of claim 13 including looping said free ends around articles to be carried and using said fastening means to reconnect to said flexible strands just upstream from the area which circumscribes the article to be carried, and attaching further articles to be carried on said closed loop strand.

15. The method of claim 14 including carrying the articles by supporting the blank with a portion of a person's body, allowing the blank to serve as a force distributing pad.

16. The method of claim 13 including storing both the strands when not in use by rolling the blank about the strands, forming a tubular container and fastening together overlapping edges of the thus formed container.

17. The method of claim 13 including storing one of the strands when that strand is not in use by rolling the blank about that strand, forming a tubular container, fastening overlapping edges of the thus formed container and allowing the strand to be used to depend from the container for article attachment.

* * * * *